US005866312A

United States Patent [19]

Wang et al.

[11] Patent Number: 5,866,312

[45] Date of Patent: Feb. 2, 1999

[54] PHOTOGRAPHIC ELEMENT HAVING SURFACE PROTECTIVE LAYER

[75] Inventors: Yongcai Wang, Penfield; Dennis E. Smith; Alfred B. Fant, both of Rochester, all of N.Y.

[73] Assignee: Eastman Kodak Company, Rochester, N.Y.

[21] Appl. No.: 878,791

[22] Filed: Jun. 19, 1997

[51] Int. Cl.[6] ..... G03C 1/89; G03C 1/76; G03C 8/15

[52] U.S. Cl. ..... 430/512; 430/527; 430/534; 430/535; 430/536; 430/537; 430/627; 430/628; 430/961

[58] Field of Search ..... 430/536, 537, 430/539, 627, 628, 961, 527, 512, 534, 535

[56] References Cited

U.S. PATENT DOCUMENTS

| | | | |
|---|---|---|---|
| 3,589,906 | 6/1971 | McDowell | 430/535 |
| 3,666,478 | 5/1972 | Bourguillon et al. . | |
| 3,884,609 | 5/1975 | Britten | 425/242 B |
| 3,888,678 | 6/1975 | Bailey et al. | 430/528 |
| 4,203,716 | 5/1980 | Chen | 430/546 |
| 4,330,618 | 5/1982 | Minamizono et al. | 430/528 |
| 5,173,739 | 12/1992 | Kurachi et al. | 356/124 |
| 5,445,320 | 8/1995 | Berthelier | 239/2.2 |
| 5,455,320 | 10/1995 | Muehlbauer et al. | 526/207 |
| 5,492,960 | 2/1996 | Muehlbauer et al. | 526/207 |
| 5,563,226 | 10/1996 | Muehlbauer et al. | 526/173 |
| 5,709,986 | 1/1998 | Smith et al. | 430/537 |

FOREIGN PATENT DOCUMENTS 0 476 535 A1 3/1992 European Pat. Off. .

*Primary Examiner*—Richard L Schilling
*Attorney, Agent, or Firm*—Carl F. Ruoff

[57] ABSTRACT

The present invention is a photographic element which includes a support, at least one silver halide emulsion layer, and a light-insensitive protective overcoat. The light insensitive protective overcoat includes a hydrophilic binder and polymer particles having a glass transition temperature of at least 70° C. The polymer particles prepared by the process of mechanically forming oil-in-water droplets having a size less than 400 nm of an ethylenically unsaturated monomer having hydrophobic groups, the hydrophobic groups having a $\log P_{(calc)}$ greater than a $\log P_{(calc)}$ of the ethylenically unsaturated monomer by at least 1 unit in an aqueous medium. A hydrophilic colloid is added to the aqueous medium in an amount sufficient to render the polymer partice compatible with the hydrophilic binder. The droplets are polymerized to a size of less than 400 nm. The present invention is also a photographic element which includes a support, at least one silver halide emulsion layer, and a light-insensitive protective overcoat. The light insensitive protective overcoat includes a hydrophilic binder and polymer particles having a glass transition temperature of at least 70° C. The polymer particles prepared by the process of mechanically forming oil-in-water droplets having a size less than 400 nm of an ethylenically unsaturated monomer having a $\log P_{(calc)}$ greater than 4, preferably greater than 6 in an aqueous medium. A hydrophilic colloid is added to the aqueous medium in an amount sufficient to render the polymer partice compatible with the hydrophilic binder. The droplets are polymerized to a size of less than 400 nm.

28 Claims, No Drawings

PHOTOGRAPHIC ELEMENT HAVING SURFACE PROTECTIVE LAYER

CROSS REFERENCE TO RELATED APPLICATIONS

This application relates to commonly assigned copending application Ser. No. 08/879,059 filed simultaneously herewith and hereby incorporated by reference for all that it discloses, This application relates to commonly assigned copending application Ser. No. 08/879,062 filed simultaneously herewith and hereby incorporated by reference for all that it discloses. This application relates to commonly assigned copending application Ser. No. 08/879,060 filed simultaneously herewith and hereby incorporated by reference for all that it discloses. This application relates to commonly assigned copending application Ser. No. 08/878,718 filed simultaneously herewith and hereby incorporated by reference for all that it discloses.

BACKGROUND OF THE INVENTION

A photographic element in general comprises a support made of, for example, cellulose triacetate, or polyethylene terephthalate, or polyethylene naphthalate, or paper. Except X-ray films that have photographic emulsion layers on both sides of the support, most photographic elements have the light sensitive emulsion layers only on one side of the support through the use of adhesion promotion subbing layers or antihalation subbing layers. The side contaning light sensitive emulsion layers (emulsion side) may also optionally contain various other layers such as interlayers, filter layers, and surface protective layers. The side without light sensitive emulsion layers is in general called the backside. The backside is normally provided with an auxiliary layer such as an antihalation layer, or an antistatic layer or an anti-curling layer, or a surface protective overcoat layer.

The surface protective layer on the emulsion side often comprises hydrophilic binders such as gelatin, for example. During the handling of photographic elements, such as coating, drying, finishing, winding, rewinding, printing, and so on, the material surfaces are often harmed by contact friction with apparatus parts and between the front and back surfaces of the element. For example, scratches or abrasion marks can be brought about on the emulsion and backsides of a photographic material. These scratches and abrasion marks can deface the image during printing and projecting processes. On irreplaceable negatives, the physical scratches or surface damages require very expensive retouching.

There have been various proposals to obtain a physically improved photographic material by increasing the abrasion and scratch resistance of the overcoat layer, or by reducing the contact friction of the photographic material to other surfaces so that it will not be damaged during the manufacturing, exposure, developing, and printing or projecting processes. For example, methods for reducing the contact friction include incorporating both a silicone fluid and a surface active agent into the protective overcoat; using a mixture of dimethyl silicone and diphenyl silicone on the backside of the support; incorporating a triphenyl terminated methyl phenyl silicone into the emulsion protective overcoat; using a combination of dimethyl silicone and beta-alanine derived surfactants; using modified sperm oils in the protective overcoat; or using liquid organopolysiloxane with methyl and alkyl or aryl, or aralkyl side groups in the protective overcoat.

A more serious problem is the formation of the so-called static marks, caused by the accumulation of electrostatic charges that are discharged before processing the photographic element. The light-sensitive emulsion layers are then exposed to light generated by the discharge. Furthermore, the attainment of dust or dirt on the surface of a photographic element can also cause serious problems after development. For example, when the images from a negative film are printed on a positive film or a photographic paper, the existence of dust or dirt on the surface of the negative film will affect the formation of the print images.

Undesirable static discharges during manufacture, exposure, and processing of a photographic element can be controlled by modification of the surface charging characteristics. Matting agents can reduce the electrostatic charging by reducing the effective area of surface making contact. Surfactants or polymers of various kinds and combinations are employed very often to balance or reduce the surface contact charge as has been disclosed, for example, in U.S. Pat. Nos. 3,589,906, 3,666,478, 3,884,609, 3,888,678, 4,330,618, and others. Commonly used surfactants or polymers for static charge control include, for example, cationic and anionic fluorinated surfactants, polymeric quaternary ammonium salts, and the like.

Finely divided powdered grains or matting agents (beads larger than 500 nm) are often incorporated into the surface protective layer to increase the surface roughness and prevent contact and subsequent sticking. It is desirable that these matte beads are non-hydrophilic and consequently they are composed of materials different from the hydrophilic binders. Because of the different composition, these matte beads may have different refractive index. When light is passed through the photographic element, such as in photographic printing or projection, both the increased surface roughness and difference in refractive index can cause a non-uniform light path and result in graininess in photographic prints or mottle in projected images. For this reason, manufacturers have been using a large amount of non-process surviving (soluble) mattes, designed to solublize in high pH solutions, in combination with a small amount of process surviving (permanent) matte. High concentrations of processing removable matte are used especially when the unprocessed photographic elements are used or stored at high relative humidity and at elevated temperatures of from 30° to 40° C. High concentrations of soluble matte are also used to prevent contact specks that cause adverse sensitometric defects when the materials are rolled up.

The use of a high level of processing removable matte provides a satisfactory solution to conventional films for amateur use, for which the processed, or developed, film strips are returned to the consumer in synthetic resin pouches, or sleeves, where the frontside and backside of the film do not come in contact with each other.

Recent patents have disclosed photographic systems where the processed element may be re-introduced into the cassette. This system allows for compact and clean storage of the processed element until such time when it may be removed for additional prints or to interface with display equipment. Storage in the roll is preferred to facilitate location of the desired exposed frame and to minimize contact with the negative. U.S. Pat. No. 5,173,739 discloses a cassette designed to thrust the photographic element from the cassette, eliminating the need to contact the film with mechanical or manual means. Published European Patent Application 0 476 535 A1 describes how the developed film may be stored in such a cassette. The dimensions of such a so-called thrust cassette require that the processed photographic element is wound tightly and under pressure, causing direct close contact between the front and back sides which results in ferrotyping, especially at high temperature and high relative humidity. Processing removable matte does not prevent this problem.

In recent years, rapid processing and high temperature drying after processing have become common practice for photographic materials. The high temperature dried films, for example 60° C. (harsh drying), tend to aggravate the ferrotyping which results from close contact, especially under elevated humidity and temperature. When ferrotyping is sufficiently severe, the resulting prints are unacceptable. Films dried at lower temperatures, for example 40° C. (mild drying), tend to show much less ferrotyping. The reason for this difference is not understood.

It is known to use synthetic polymer particles in a silver halide photographic element to improve physical characteristics. In particularly, water dispersible polymer particles obtained by emulsion polymerization technique (polymer latex particles) have found wide use as partial replacement for gelatin. Many latex polymers, however, are incompatible or unstable for effective coating in protective layers coated from hydrophilic colloid solutions such as gelatin solutions which include various addenda as described above. These addenda, especially coating surfactants and antistatic control surfactants or polymers, can significantly reduce the stability of polymer latex particles, for example, by reducing the electrostatic repulsion force from the interaction between electrical double layers, or surface charges on the particles. Surfactants or charge control polymers can carry opposite charges to those on the polymer latex particle surface leading to latex particle flocculation through charge neutralization.

It has been heretofore known to employ latex polymer particles in photographic elements that are compatible with gelatin. However, they have been found to frequently provide unacceptable post-process ferrotyping protection, especially for elements having magnetic recording layers which are reintroduced into a cassette after processing.

PROBLEM TO BE SOLVED BY THE PRESENT INVENTION

Therefore an objective of the present invention is to provide a photographic element comprising polymer particles having excellent stability with respect to the manufacturing process of photographic materials. Another objective is to provide such an element without causing additional haze or generating spot defects harmful to photographic performance. It is yet a further objective to provide a photographic element with superior resistance to ferrotyping between front and back sides even at high temperatures and in moist environments.

SUMMARY OF THE INVENTION

The present invention is a photographic element which includes a support, at least one silver halide emulsion layer, and a light-insensitive protective overcoat. The light insensitive protective overcoat includes a hydrophilic binder and polymer particles having a glass transition temperature of at least 70° C. The polymer particles are prepared by the process of mechanically forming oil-in-water droplets having a size less than 400 nm of an ethylenically unsaturated monomer having hydrophobic groups, the hydrophobic groups having a $\log P_{(calc)}$ greater than a $\log P_{(calc)}$ of the ethylenically unsaturated monomer by at least 1 unit in an aqueous medium. A hydrophilic colloid is added to the aqueous medium in an amount sufficient to render the polymer partice compatible with the hydrophilic binder. The droplets are polymerized to a mean size of less than 400 nm.

The present invention is also a photographic element which includes a support, at least one silver halide emulsion layer, and a light-insensitive protective overcoat. The light insensitive protective overcoat includes a hydrophilic binder and polymer particles having a glass transition temperature of at least 70° C. The polymer particles prepared by the process of mechanically forming oil-in-water droplets having a size less than 400 nm of an ethylenically unsaturated monomer having a $\log P_{(calc)}$ greater than 4, preferably greater than 6 in an aqueous medium. A hydrophilic colloid is added to the aqueous medium in an amount sufficient to render the polymer partice compatible with the hydrophilic binder. The droplets are polymerized to a size of less than 400 nm.

DETAILED DESCRIPTION OF THE INVENTION

Photographic elements according to this invention can differ widely in structure and composition. For example, they can vary greatly in regard to the type of the support, the number and composition of the imaging forming layers, and the kinds of auxiliary layers that are included in the elements. Typical supports include cellulose nitrate film, cellulose acetate film, poly(vinyl acetal) film, polystyrene film, poly(ethylene terephthalate) film, poly(ethylene naphthalate) film, polycarbonate film, and the like. The supports may be annealed and the thickness of the support is not critical. Support thickness of 2 to 10 mil (0.002 to 0.010 inches) can be used. The supports typically employ an undercoat or subbing layer well known in the art that comprises, for example, for polyester support a vinylidene chloride/methyl acrylate/itaconic acid terpolymer or vinylidene chloridelacrylonitrile/acrylic acid terpolymer.

The photographic element of the present invention has a light-insensitive protective overcoat comprising a hydrophilic binder and polymer particles. The polymer particles in the protective overcoat in accordance with the present invention have a mean particle size of less than 400 nm and preferably less than 250 nm, and a glass transition temperature of at least 70° C. Polymer particles having a glass transition temperature less than 70° C. are not effective in preventing post process ferrotyping. The weight ratio of the polymer particle to hydrophilic binder ranges from 5:95 to 90:10, preferably from 10:90 to 50:50, and most preferably from 10:90 to 40:60. The polymer particles are prepared by the process of mechanically forming oil-in-water droplets having a mean size of less than 400 nm where the droplets comprise an ethylenically unsaturated monomer and a compound having a higher $\log P_{(calc)}$ value than the monomer by at least one unit; or an ethylenically unsaturated monomer having a $\log P_{(calc)}$ value greater than 4, preferably greater than 6; adding to the aqueous media an effective amount of a hydrophilic colloid, preferably subsequent to the formation of the droplets and before the commencement of the polyaddition reaction; and polymerizing the oil-in-water droplets using a free radical initiator to form solid polymer particles having a mean size essentially the same as the oil-in-water droplets.

The process of the instant invention differs from traditional suspension and emulsion polymerization. In traditional suspension polymerization, a polymerizable liquid is dispersed as droplets in a continuous aqueous medium and polymerized under continuous agitation. Normally, this process is carried out in the presence of a "granulating agent", such as a lyophilic polymer (starch, natural gums, polyvinyl alcohol, or the like) or an insoluble fine powder such as calcium phosphate. These granulating agents help to obtain a dispersion of droplets of the polymerizable liquid but do not provide sufficient stabilization of the dispersion so that the dispersed droplets are stable in the absence of agitation. Therefore, in the suspension polymerization method, it is necessary to carry out the polymerization under continuous high energy mechanical agitation, since otherwise extensive coalescence of the droplets will occur, with separation of a bulk phase of water-immiscible, polymerizable material or the formation of large amounts of coagulum. Because the process depends on the details of the shear field in the reactor and on the changing viscosity of the polymerizing dispersed phase, it is difficult to control reproducibly, it is not readably scaleable, and it gives broad particle size distributions (PSD).

In conventional emulsion polymerization, on the other hand, ethylenically unsaturated monomers are added to an aqueous phase that contains surfactant above the critical micelle concentration and a water-soluble initiator. The mechanism of the polymerization process has been subject of much research and is generally agreed to include emulsification of monomer into a continuous aqueous phase to form monomer droplet having a size of about 1 to 10 $\mu$m and diffusion of the monomer from the monomer droplets into surfactant micelles where the actual polymerization proceeds. Homogeneous nucleation will also occur for recipes with low surfactant concentration or monomers of relatively high water solubility, but polymerization in the monomer droplets is deemed insignificant. Thus, monomer droplets are formed to a size much larger than the resultant polymer particles and function solely as reservoirs holding the monomer until it diffuses into the growing micelles.

Particles prepared by conventional emulsion polymerization process have a size and size distribution very sensitive to the type and amount of surfactant, initiator concentration, and decomposition kinetics. It does not allow a direct control of particle size and size distribution by control of monomer droplet size and distribution.

The preparation of polymer particles in accordance with the present invention involves dispersing the water-insoluble monomer in the presence of a dispersion stabilizer or granulating agent to the desired size by using a mechanical shearing device such as an agitator, a high pressure homogenizer, colloid mill, an ultrasonic horn or the like, and carrying out polymerization with little or minimal stirring (only enough to prevent creaming and to provide good thermal transfer). This differs from the suspension polymerization in which the polymerization is carried out under continuous high energy mechanical agitation, since otherwise extensive coalescence of the droplets will occur, with separation of a bulk phase of water-immiscible, polymerizable material or the formation of large amounts of coagulum. For any given monomer, the energy required to form monomer droplets smaller than 400 nm is significantly greater than the energy required to form monomer droplets from 1 to 10 $\mu$m as previously described for emulsion polymerization where the monomer droplets are used as reservoirs and disappear by diffusion as the polymerization proceeds. Any of the above listed equipment, as long as it imparts sufficient shearing energy, can be used in the practice of the instant invention. Sufficient shearing energy is provided by approximately a rate of shear (or velocity gradient ) of $10^5$ $min^{-1}$ or greater, more preferably $10^6$ $min^{-1}$ or greater. By rate of shear is meant is a value obtained by dividing an absolute value of a difference of speeds of two planes by a distance between said two planes. A high pressure homogenizer operated at 1400 psi provides a rate of shear approximately equal to $6\times10^6$ $min^{-1}$. High pressure homogenizers are preferred.

In conventional emulsion polymerization, the principal locus of particle nucleation is the aqueous phase or the monomer swollen micelles depending on the degree of water solubility of the monomers and the amount of surfactants used; lowering water solubility of monomer and higher amounts of surfactants would favor nucleation in monomer swollen micelles. Monomer droplets are only considered to act as monomer reservoirs supplying monomers to the growing polymer particles. Therefore, particle size and size distribution are very sensitive to the type and amount of surfactants, initiator concentration and decomposition kinetics, reaction temperature, comonomers, ionic strength, and impurities such as oxygen present in the reaction medium. In the polymerization process of the present invention, the polymer particles size and size distribution are controlled by controlling the monomer droplet size and distribution. The small sizes of monomer droplets generated by homogenization are principal locus of particle nucleation. The particle size and size distribution become strongly dependent on the amount of mechanical energy and shear used in the homogenization step, and less dependent on the type and amount of surfactants, and initiator concentration.

Various dispersion stabilizers or granulating agents which can be used in practice of the present invention are well known in the art, they include, for example, surfactants including anionic, cationic and nonionic surfactants, such as sulfonated alkyl aryl polyethers, ethylene glycol ethers of polyhydric alcohols, carboxy alkyl substituted polyglycol ethers and esters, fluoro-substituted compounds, sucrose esters of aliphatic acids, maleic ester amides, sodium salts of the condensation products of naphthalene sulfonic acid and formaldehyde, phosphate esters of glycol polyethers, long chain sucrose ethers, higher alcohol sulfates, water soluble salts of aliphatic esters of sulfosuccinic acid, fatty acid esters of hydroxy alkyl sulfonic acids, amide and ester derivatives of sulfon-acetic acid, and the like. The dispersion stabilizer is added to the aqueous media prior to the formation of oil-in-water droplets.

In accordance with the presence invention, an effective amount of a hydrophilic colloid is added to the aqueous media before the commencement of polyaddition reaction, preferably subsequent to the formation of oil-in-water droplets. Suitable hydrophilic colloids include gelatin, polyvinyl alcohol, polyvinyl pyrrolidone, starch, natural gum, and the like. The hydrophilic colloid is used in an effective amount to improve the compatibility of the polymer particle with the hydrophilic binder and various addenda used in the light-insensitive surface protective overcoat The effective amount is somewhere dependent on the size of the polymer particles. A preferred amount is at least 0.1 weight percent and most preferably at least 0.5 weight percent based on the weight of the monomer. The upper limit of the quantity of the hydrophilic colloid is controlled by practical considerations, such as viscosity and economic considerations. Gelatin is the most preferred hydrophilic colloid.

Polymer particles produced by the process of the present invention are required to contain hydrophobic groups in order to prevent diffusional growth of the droplets prior to polymerization. The hydrophobic group can be any compound present in the monomer droplets but preferred is a non-reactive m compound. Any of the non-reactive compounds having hydrophobic properties defined in terms of $logP_{(calc)}$ as set forth in commonly owned U.S. Pat. No. 5,455,320, issued Oct. 3, 1995, may be used. $LogP_{(calc)}$ is the logarithm of the octanol-water partition coefficient calculated using Medchem version 3.54, a software package available from Medicinal Chemistry Project, Pomona College, Clairmont, Calif. The software package is well known and accepted in the chemical and pharmaceutical industries. $LogP_{(calc)}$ is a parameter which is highly correlated with measured water solubility for compounds spanning a wide range of hydrophobicity. The non-reactive hydrophobic compounds used in the present invention are either liquid or oil soluble solids. As indicated above, the non-reactive compound is more hydrophobic than the monomer or monomers and has a higher $logP_{(calc)}$ than the monomer by at least 1 unit and more preferably by 3 units. Suitable non-reactive hydrophobic compounds are those selected from the following classes of compounds, among others:

I. Saturated and unsaturated hydrocarbons and halogenated hydrocarbons, including alkanes, alkenes, alkyl and alkenyl halides, alkyl and alkenyl aromatic compounds, and halogenated alkyl and alkenyl aromatic compounds, especially those having a $LogP_{(calc)}$ greater than about 3.

II. Esters of saturated, unsaturated, or aromatic carboxylic acids containing a total of about 10 or more carbon atoms, especially those having a $LogP_{(calc)}$ greater than about 3.

III. Amides of carboxylic acids having a total of 10 or more carbon atoms, especially those having a $LogP_{(calc)}$ greater than about 3.

IV. Esters and amides of phosphorus- and sulfur-containing acids having a $LogP_{(calc)}$ greater than about 3, and other compounds of similar hydrophobicity.

Compounds of Class I include: straight or branched chain alkanes such as, for example, hexane, octane, decane, dodecane, tetradecane, hexadecane, octadecane, 2,2,6,6,9,9-hexamethyldodecane, eicosane, or triacontane; alkenes such as, for example, heptene, octene, or octadecene; substituted aromatic compounds such as, for example, octylbenzene, nonylbenzene, dodecylbenzene, or 1,1,3,3-tetramethylbutylbenzone; haloalkanes such as, for example, heptyl chloride, octyl chloride, 1,1,1-trichlorohexane, hexyl bromide, 1,11-dibromoundecane, and halogenated alkyl aromatic compounds such as, for example, p-chlorohexylbenzene and the like.

Compounds of Class II include: methyl laurate, butyl laurate, methyl oleate, butyl oleate, methyl stearate, isopropyl palmitate, isopropyl stearate, tributyl citrate, acetyl tributyl citrate, phenethyl benzoate, dibutyl phthalate, dioctyl phthalate, dioctyl terephthalate, bis(2-ethylhexyl) phthalate, butyl benzyl phthalate, diphenyl phthalate, dibutyl sebacate, didecyl succinate, and bis(2-ethylhexyl) azelate and the like.

Compounds of Class III include: lauramide, N-methyllauramide, N,N-dimethyllauramide, N,N-dibutyllauramide, N-decyl-N-methylacetamide, and N-oleylphthalimide and the like.

Compounds of Class IV include, for example, sulfates, sulfonates, sulfonamides, sulfoxides, phosphates, phosphonates, phosphinates, phosphites, or phosphine( oxides. Particular examples include diesters of sulfuric acid, such as, for example, dihexylsulfate, didecylsulfate, and didodecylsulfate; esters of various alkyl sulfonic acids including, for example, methyl decanesulfonate, octyl dodecanesulfonate, and octyl p-toluenesulfonate; sulfoxides, including, for example, bis(2-ethylhexyl) sulfoxide; and sulfonamides, including, for example, N-(2-ethylhexyl)-p-toluenesulfonamide, N-hexadecyl-p-toluenesulfonamide, and N-methyl-N-dodecyl-p-toluenesulfonamide. Phosphorus-containing compounds include, for example, triesters of phosphoric acid such as, for example, triphenyl phosphate, tritolylphosphate, trihexylphosphate, and tris(2-ethylhexyl)phosphate; various phosphonic acid esters, such as, for example, dihexyl hexylphosphonate, and dihexyl phenylphosphonate; phosphite esters such as tritolylphosphite, and phosphine oxides such as trioctylphosphine oxide.

Representative compounds are given below, along with their $LogP_{(calc)}$ value, calculated using the above-mentioned MedChem software package (version 3.54).

| Nonreactive Compound | $LogP_{calc}$ |
|---|---|
| hexane | 3.87 |
| octane | 4.93 |
| decane | 5.98 |
| dodecane | 7.04 |
| hexadecane | 9.16 |
| dimethylphthalate | 1.36 |
| dibutylphthalate | 4.69 |
| bis(2-ethylhexyl)phthalate | 8.66 |
| dioctylphthalate | 8.92 |
| tritolylphosphate | 6.58 |
| tris(2-ethylhexyl)phosphate | 9.49 |
| dodecylbenzene | 8.61 |
| bis(2-ethylhexyl)azelate | 9.20 |
| trioctylphosphine oxide | 9.74 |
| dinonyl phthalate | 9.98 |
| didecyl phthalate | 11.04 |
| didodecyl phthalate | 13.15 |
| 3-(4-hydroxy-3,5-di-t-butylphenyl)-propionic acid, octadecyl ester | 14.07 |
| trioctyl amine | 10.76 |

| Monomer | $LogP_{(calc)}$ |
|---|---|
| acrylic acid | 0.16 |
| isopropyl acrylamide | 0.20 |
| β-(hydroxyethyl) methacrylate | 0.25 |
| vinyl acetate | 0.59 |
| methyl acrylate | 0.75 |
| methyl methacrylate | 1.06 |
| ethyl acrylate | 1.28 |
| ethyl methacrylate | 1.59 |
| butyl acrylate | 2.33 |
| butyl methacrylate | 2.64 |
| styrene | 2.89 |
| divinyl benzene | 3.59 |
| mixture of vinyl toluenes | 3.37 |
| 2-ethylhexyl acrylate | 4.32 |
| 2-ethylhexyl methacrylate | 4.62 |
| t-butylstyrene | 4.70 |
| lauryl methacrylate | 6.88 |
| stearyl metacrylate | 10.05 |

The hydrophobic compound is employed in an amount of at least it 5 about 0.01, preferably at least about 0.05 and most preferably at least about 0.5 percent by weight based on the weight of the monomer. Hexadecane is the preferred nonreactive compound.

The hydrophobe can also be the polymerization initiator. Especially effective are peroxides with long alkyl chains such as lauroyl peroxide which has a $logP_{(calc)}$ of 10.61. Additionally, the hydrophobe can be a chain transfer agent such as dodecanethiol which has a $logP_{(calc)}$ of 6.47, or it can be a polymerizable monomer such as lauryl methacrylate or stearyl methacrylate.

In some cases, the monomers used to form polymer particles are sufficiently hydrophobic so that another hydrophobic additive is not required. If the monomer has a $logP_{(calc)}$ greater than 4, preferably greater than 6, then another hydrophobic component is not required.

Suitable ethylenically unsaturated monomers which are useful to practice the present invention include, for example, the following monomers and their mixtures: alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, stearyl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, and the nitrile and amides of the same acids such as acrylonitrile, methacrylonitrile, and butyl acrylamide, vinyl acetate, vinyl propionate, vinylidene chloride, vinyl chloride, and vinyl aromatic compounds such as styrene, t-butyl styrene, ethyl vinyl benzene, vinyl toluene, dialkyl maleates, dialkyl itaconates, dialkyl malonates, isoprene, and butadiene. Crosslinking and grafting monomers which may be used together with the foregoing monomers to crosslink the polymer particles are polyfunctional with respect to the polymerization reaction, and may include, for example, esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate, esters of saturated glycols or diols with unsaturated monocarboxylic acids, such as ethylene glycol diacrylate, ethylene glycol dimethacrylate, triethylene glycol dimethacrylate, 1,4-butanediol dimethacrylate, 1,3-butanediol dimethacrylate, and polyfunctional aromatic compounds such as divinyl benzene.

The polymerization process is initiated in general with free radical initiators. Free radicals of any sort may be used. Preferred initiators include persulfate, peroxides, azo compounds, and redox initiators. The amount of initiator can vary from 0.01% to 2% by the weight of monomer, but is preferably from 0.03 to 1 % by weight thereof. Organic peroxides and organic peresters include, for example, benzoyl peroxide, dichlorobenzoyl peroxide, dicumyl peroxide, di-tert-butyl peroxide, lauroyl peroxide, tert-butyl peracetate, 2,5-dimethyl-2,5-di(tert-butylperoxy)hexine-3,2,5-dimethyl-2,5-di(tert-butylperoxy)hexane, tert-butyl perbenzoate, tert-butyl perphenyl acetate, tert-butylperisobutylate, tert-butyl per-secoctoate, tert-butyl perpivalate, cumyl perpivalate and tert-butyl perdiethyl acetate, and azo compounds include, for example, azobisisobutylnitrile and dimethyl azoisobutylate.

Suitable hydrophilic binders which can be used in practice of this invention include naturally occurring substances such as proteins, protein derivatives, cellulose derivatives (e.g. cellulose esters), polysaccharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer or copolymers containing styrene sulfonic acid, and the like. Gelatin is the most preferred hydrophilic binder.

The hydrophilic binder is preferably cross-linked so as to provide a high degree of cohesion and adhesion. Cross-linking agents or hardeners which may effectively be used in the coating compositions of the present invention include aldehydes, epoxy compounds, polyfunctional aziridines, vinyl sulfones, methoxyalkyl melamines, triazines, polyisocyanates, dioxane derivatives such as dihydroxydioxane, carbodiimides, chrome alum, zirconium sulfate, and the like.

The protective layer useful in the practice of the invention may optionally contain thickeners, ultraviolet ray absorbers, processing removable dyes, silver halide, colloidal inorganic particles, magnetic recording particles, various other additives and the like.

The protective layer useful in the practice of the invention may also contain lubricants, coating aids, matting agents, and antistats or charge control surfactants. Known lubricants, coating aids, matting agents, and antistats or charge control surfactants have been described in detail in Research Disclosure No. 38957 September 1996, section IX on "Coating Physical Property Modification Addenda".

The photographic element of the present invention can contain at least one electrically conductive layer, which can be either a surface protective layer or a sub layer. The surface resistivity of at least one side of the support is preferably less than $1\times10^{12}$ Ω/□, more preferably less than $1\times10^{11}$ Ω/□ at 20° C. and 20 percent relative humidity. To lower the surface resistivity, a preferred method is to incorporate at least one type of electrically conductive material in the electrically conductive layer. Such materials include both conductive metal oxides and conductive polymers or oligomeric compounds. Such materials have been described in detail in, for example, U.S. Pat. Nos. 4,203,769; 4,237,194; 4,272,616; 4,542,095; 4,582,781; 4,610,955; 4,916,011; and 5,340,676.

The coating composition of the invention can be applied by any of a number of well-know techniques, such as dip coating, rod coating, blade coating, air knife coating, gravure coating and reverse roll coating, extrusion coating, slide coating, curtain coating, and the like. The ultraviolet ray absorbing particles and the binder are mixed together in a liquid medium to form a coating composition. After coating, the layer is generally dried by simple evaporation, which may be accelerated by known techniques such as convection heating. Known coating and drying methods are described in further detail in Research Disclosure No. 308119, Published Dec. 1989, pages 1007 to 1008.

In a particularly preferred embodiment, the imaging elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The present invention is also directed to a single use camera having incorporated therein a photographic element as described above. Single use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic materials are exposed in camera, and then the product is sent to the developer who removes the photographic material and develop it. Return of the product to the consumer does not normally occur.

Single use camera and their methods of manufacture and use are described in U.S. Pat. Nos. 4,801,957; 4,901,097; 4,866,459; 4,849,325; 4,751,536; 4,827,298; European Patent Applications 460,400; 533,785; 537,225; all of which are incorporated herein by reference.

The photographic processing steps to which the raw film may be subject may include, but are not limited to the following:

1.) color developing→bleach-fixing→washing/stabilizing;

2.) color developing→bleaching→fixing→washing/stabilizing;

3.) color developing→bleaching→bleach-fixing→washing/stabilizing;

4.) color developing→stopping→washing→bleaching→washing→fixing→washing/stabilizing;

5.) color developing→bleach-fixing→fixing→washing/stabilizing;

6.) color developing→bleaching→bleach-fixing→fixing→washing/stabilizing;

Among the processing steps indicated above, the steps 1), 2), 3), and 4) are preferably applied. Additionally, each of the steps indicated can be used with multistage applications as described in Hahm, U.S. Pat No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92117819; WO 93/04404; WO 92/17370; WO 91/19226; WO 91-12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. Nos. 5,313,243; 5,339,131.

The present invention is also directed to photographic systems where the processed element may be re-introduced into the cassette. These system allows for compact and clean storage of the processed element until such time when it may be removed for additional prints or to interface with display equipment. Storage in the roll is preferred to facilitate location of the desired exposed frame and to minimize contact with the negative. U.S. Pat. No. 5,173,739 discloses a cassette designed to thrust the photographic element from the cassette, eliminating the need to contact the film with mechanical or manual means. Published European Patent Application 0 476 535 A1 describes how the developed film may be stored in such a cassette.

The present invention will now be described in detail with reference to examples; however, the present invention should not limited by these examples.

EXAMPLE 1

(Invention) Preparation of Poly(methyl Methacrylate) Particle P-1

To a beaker are added the following ingredients: 800 g methyl methacrylate, 21.6 g Aerosol OT-100 (dioctyl ester of sodium sulfosuccinic acid), and 12 g lauroyl peroxide. The lauryl peroxide initiator is used as hydrophobe. The ingredients are stirred until all the solids are dissolved. This solution is added to 2520 g distilled water and stirred with a marine prop type agitator for 5 minutes. The mixture is passed through a Gaulin Mill operated at 3600 rpm, 0.5 gallon/minute flow and a gap of 0.01 inches. This material is then passed through a Crepaco Homogenizer operated at 5000 psi to form the final droplet size. 1000 g of the droplet dispersion is placed in a bottle with 22.75 g of a deionized gelatin. The bottle is sealed and reacted in a tumble bath at 52 degrees C. for 16 hours. The particles prepared by this process are stable and have a mean size of 102 nm. The particle is designated as P-1.

EXAMPLE 2

(Invention) Preparation of Poly(methyl Methacrylate-co-ethylene Glycol Dimethacrylate) Particles Loaded with Ultraviolet Ray Absorber I.

To a beaker are added the following ingredients: 632 g methyl methacrylate, 168 g ethylene glycol dimethacrylate, 20 g hexadecane, 266 g Ultraviolet Ray Absorber I (supra), 28.8 g Aerosol OT-100 (dioctyl ester of sodium sulfosuccinic acid) and 16 g 2,2'-azobis(2,4-dimethylvaleronitile) sold by DuPont under the trade name Vazo 52. The ingredients are stirred until all the solids are dissolved. This solution is added to 3360 g distilled water and stirred with a marine prop type agitator for 5 minutes. The mixture is passed through a Gaulin Mill operated at 3600 rpm, 0.5 gallon/minute flow and a gap of 0.01 inches. This material is then passed through a Crepaco Homogenizer operated at 5000 psi to form the final droplet size. 250 g of the droplet dispersion is placed in a bottle with 12.25 g of a deionized gelatin. The bottle is sealed and reacted in a tumble bath at 52 degrees C. for 16 hours. The particles prepared by this process are stable, contain 3 parts of polymer to 1 part of ultraviolet ray absorber, and have a mean size of about 149 nm. The particle is designated as P-2.

EXAMPLE 3

(Comparative) Preparation of Comparative Polymer Latex P-3

A stirred reactor containing 1012 g of deionized water and 3 g of Triton 770 surfactant (Rohm & Haas Co.) is heated to 80° C. and purged with $N_2$ for 1 hour. After addition of 1 g of potassium persulfate, an emulsion containing 2.7 g of Triton 770 surfactant, 267 g of water, 225 g of methyl methacrylate, and 0.5 g of potassium persulfate is slowly added over a period of 1 hour. The reaction is allowed to continue for 4 more hours before the reactor is cooled down to room temperature. The latex prepared is filtered through an ultrafine filter (5 $\mu$m cut-off) to remove any coagulum. The resultant particle has a size of about 25.3 nm and is designated as P-3.

EXAMPLE 4

(Comparative) Preparation of Comparative Polymer Latex P-4

Polymer latex particle P-4 is prepared in a similar manner. P-4 contains about 95% of methyl methacrylate and 5% acrylamido-2-methylpropane sulfonic acid, sodium salt, and has a size of about 48.5 nm.

EXAMPLES 5–8

Photographic Elements

A series of photographic elements are prepared as follows: A poly(ethylene naphthalate) support is used having an antihalation layer on one side and an antistatic layer overcoated with a photographically transparent magnetic recording layer on the other side. The magnetic recording layer comprises a dispersion of colbalt-modified γ-iron oxide particles in a polymeric binder with a crosslinker and abrasive particles. The polymeric binder is a mixture of cellulose diacetate and cellulose triacetate. Total dry coverage for the magnetic layer is normally about 1.5 g/m$^2$. The-support is coated on the antihalation layer side with the following imaging forming layer in sequence.

Interlayer:

This layer comprises compound 2,5-di-t-octyl-1,4-dihydroxy benzene (0.075 g/m$^2$), tri(2-ethylhexyl)phosphate (0.113 g/m$^2$), and gelatin (0.86 g/m$^2$).

Slow Cyan Dye-forming Layer:

This layer comprises a red sensitive silver bromoiodide emulsion (3.3 mole percent iodide) (0.324 $\mu$m grain size) (0.387 g/m$^2$ silver), compound CC-1 (0.355 g/m$^2$), IR-4 (0.011 g/m$^2$), B-1 (0.075 g/m$^2$), S-2 (0.377 g/in2), S-3 (0.098 g/m$^2$), and gelatin (1.64 g/m$^2$).

Mid Cyan Dye-forming Layer:

This layer comprises a blend of a red sensitive silver bromoiodide emulsion (3.3 mole percent iodide) (0.488 $\mu$m grain size) (0.816 g/m$^2$ silver) and a red sensitive, tabular grain, silver bromoiodide emulsion (4.5 mole percent iodide) (0.98 $\mu$m diameter by 0.11 $\mu$m thick) (0.215 g/m$^2$ silver), compound CC-1 (0.183 g/m$^2$), IR-3 (0.054 g/m$^2$), B-1 (0.027 g/m$^2$), CM-1 (0.011 g/m$^2$), S-2 (0.183 g/m$^2$), S-3 (0.035 g/m$^2$), S-5 (0.054 g/m$^2$), and gelatin (1.35 g/m$^2$).

Fast Cyan Dye-forming Layer:

This layer comprises a red sensitive, tabular grain, silver bromoiodide emulsion (4.5 mole percent iodide) (1.10 $\mu$m diameter by 0.11 $\mu$m thick) (1.08 g/m$^2$ silver), compound CC-1 (0.161 g/m$^2$), IR-3 (0.038 g/m$^2$), IR-4 (0.038 g/m$^2$), CM-1 (0.032 g/m$^2$), S-2 (0.237 g/m$^2$), S-5 (0.038 g/m$^2$), and gelatin (1.35 g/m$^2$).

Interlayer:

This layer comprises 2,5-di-t-octyl-1,4-dihydroxy benzene (0.075 g/m$^2$), tri(2-ethylhexyl)phosphate (0.113 g/m$^2$), and gelatin (0.86 g/m$^2$).

Slow Magenta Dye-forming Layer:

This layer comprises a blend of a green sensitive, tabular grain, silver bromoiodide emulsion (1.5 mole percent iodide) (0.7 $\mu$m diameter by 0.112 $\mu$m thick) (0.258 g/m$^2$ Ag), and a green sensitive, tabular grain, silver bromoiodide emulsion (1.3 mole percent iodide) (0.54 g/m diameter by 0.086 $\mu$m thick) (0.409 g/m$^2$ Ag), compound M-1 (0.204 g/m$^2$), MM-1 (0.038 g/m$^2$), ST-1 (0.020 g/m$^2$), S-1 (0.26 g/m$^2$), and gelatin (1.18 g/m$^2$).

Mid Magenta Dye-forming Layer

This layer comprises a green sensitive, tabular grain, silver bromoiodide emulsion (4.5 mole percent iodide) (0.61 $\mu$m diameter by 0.12 $\mu$m thick) (0.646 g/m$^2$ Ag), compound M-1 (0.099 g/m$^2$), MM-1 (0.027 g/m$^2$), IR-2 (0.022 g/m$^2$), ST-1 (0.010 g/m$^2$), S-1 (0.143 g/m$^2$), S-2 (0.044 g/m$^2$), and gelatin (1.41 g/m$^2$).

Fast Magenta Dye-forming Layer

This layer comprises a green sensitive, tabular grain, silver bromoiodide emulsion (4.5 mole percent iodide) (0.98 $\mu$m diameter by 0.113 $\mu$m thick) (0.699 g/m$^2$ Ag), compound M-1 (0.052 g/m$^2$), MM-1 (0.032 g/m$^2$), IR-2 (0.022 g/m$^2$), ST-1 (0.005 g/m$^2$), S-1 (0.111 g/m$^2$), S-2 (0.044 g/m$^2$), and gelatin (1.123 g/m$^2$).

Yellow Filter Layer:

This layer comprises 2,5-di-t-octyl-1,4-dihydroxy benzene (0.075 g/m$^2$), YD-2 (0.108 g/m$^2$), Irganox 1076 sold by Ciba-Geigy (0.01 g/m$^2$), S-2 (0.121 g/m$^2$), and gelatin (0.861 g/m$^2$).

Slow Yellow Dye-forming Layer:

This layer comprises a blend of a blue sensitive, tabular grain, silver bromoiodide emulsion (4.5 mole percent iodide) (1.4 $\mu$m diameter by 0.131 $\mu$m thick) (0.161 g/m$^2$ Ag), a blue sensitive, tabular grain, silver bromoiodide emulsion (1.5 mole percent iodide) (0.85 $\mu$m diameter by 0.131 $\mu$m thick) (0.0.108 g/m$^2$ Ag), and a blue sensitive, tabular grain, silver bromoiodide emulsion (1.3 mole percent iodide) (0.54 $\mu$m diameter by 0.086 $\mu$m thick) (0.161 g/m$^2$ Ag), compound Y-1 (0.915 g/m$^2$), IR-1 (0.032 g/m$^2$), B1-1 (0.0065 g/m$^2$), S-1 (0.489 g/m$^2$), S-3 (0.0084 g/m$^2$), and gelatin (1.668 g/m$^2$).

Fast Yellow Dye-forming Layer:

This layer comprises a blue sensitive, tabular grain, silver bromoiodide emulsion (4.5 mole percent iodide) (2.3 $\mu$m diameter by 0.128 $\mu$m thick) (0.43 g/m$^2$ Ag), compound Y-1 (0.15 g/m$^2$), IR-I (0.032 g/m$^2$), B-1 (0.0054 g/m$^2$), S-1 (0.091 g/m$^2$), S-3 (0.0070 g/m$^2$), and gelatin (0.753 g/m$^2$).

Second Protective Layer:

Various compositions according to Table 1.

First Protective Layer:

Various compositions according to Table 2.

Y1

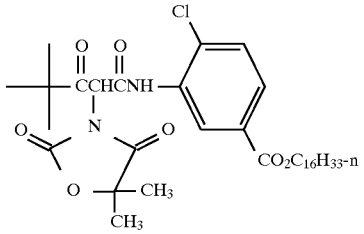

IR-1

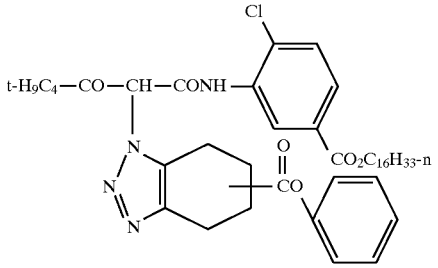

YD-2

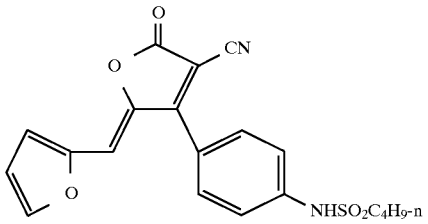

ST-1

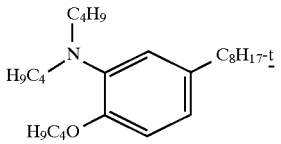

-continued
IR-2
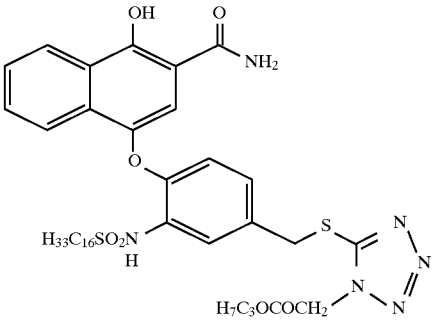
IR-3
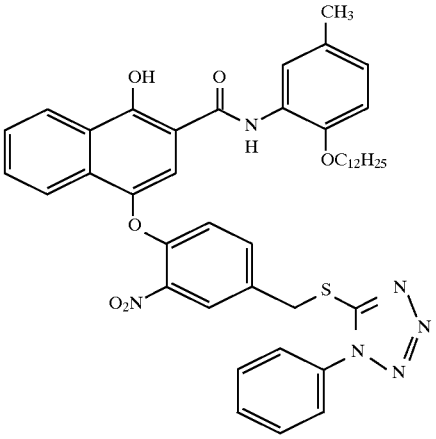
IR-4
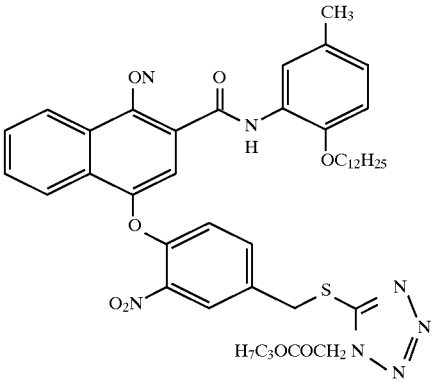
B-1
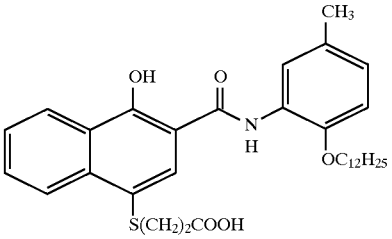

-continued
M-1
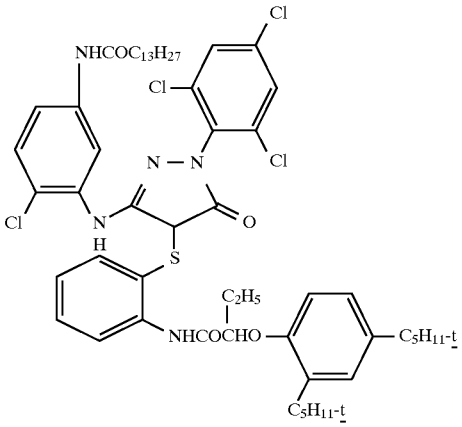
MM-1
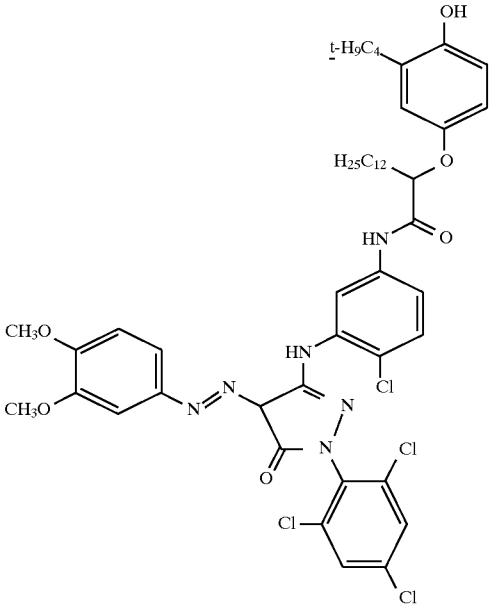
CC-1
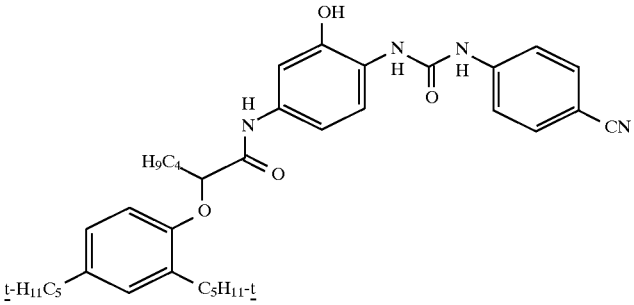

-continued
CM-1
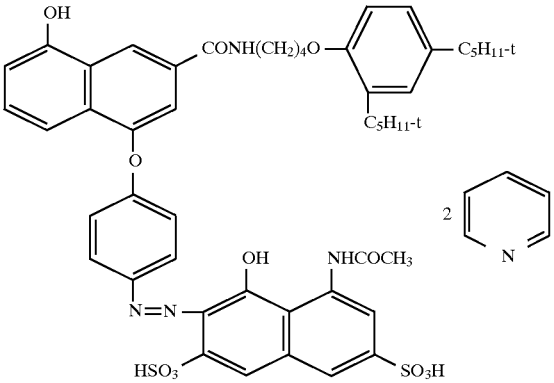
S-1
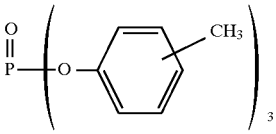
S-2
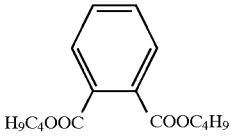
S-3
$C_{11}H_{23}CON(C_2H_5)_2$
S-4
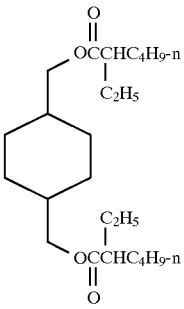
S-5
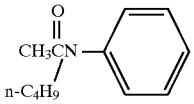
AHU-1
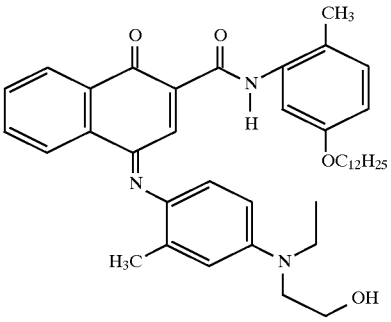

-continued

AHU-2

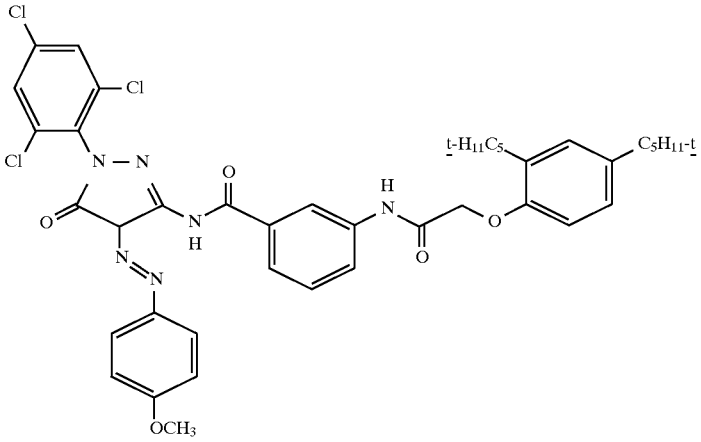

AHU-3

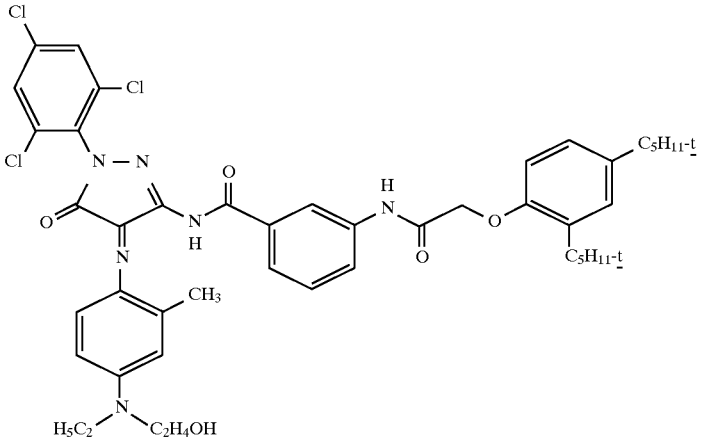

TABLE 1

| Composition of the Second Protective Layer | |
|---|---|
| Gelatin, lime processed | 0.7 g/m$^2$ |
| Colloidal silver | 0.215 g/m$^2$ |
| Ultraviolet ray absorber | Table 3 |

TABLE 2

| Composition of the First Protective Layer | |
|---|---|
| Gelatin, lime processed | 0.888 g/m$^2$ |
| Silicone lube, DC-200 (Dow Corning) | 0.0401 g/m$^2$ |
| Fluorad FC-134 (3M Co.) | 0.0039 g/m$^2$ |
| Aerosol OT (American Cyanamide) | 0.0215 g/m$^2$ |
| Surfactant Olin 10G (Olin Corp.) | 0.0272 g/m$^2$ |
| Poly(methyl methacrylate) matte, 1.5 $\mu$m | 0.0538 g/m$^2$ |
| Poly(methyl methacrylate-co-methacrylic acid) 47/53 wt % 2.7 $\mu$m | 0.107 g/m$^2$ |
| Polymer Particles | Table 3 |

The following dispersions are used for preparing the photographic elements listed in Table 3. The polymer particles are loaded with the following ultraviolet ray absorbers.

Ultraviolet Ray Absorber I

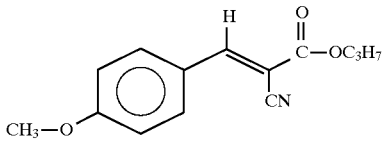

Ultraviolet Ray Absorber II

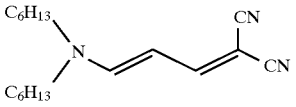

Dispersion-1: Dispersion-1 is prepared by first dissolving Ultraviolet Ray Absorber I and Ultraviolet Ray Absorber II in a high boiling organic solvent, and then dispersing the resultant solutions in an aqueous gelatin solution by a homogenizer at 3500 psi and 45° C.

Dispersion-2: Dispersion-2 is prepared by first dissolving Ultraviolet Ray Absorber II in a high boiling organic solvent, and then dispersing the resultant solutions in an aqueous gelatin solution by a homogenizer at 3500 psi and 45° C.

TABLE 3

| | First Protective Layer | | Second Protective Layer | |
|---|---|---|---|---|
| Examples | Polymer | mg/m$^2$ | Ultraviolet Ray Absorber | mg/m$^2$ |
| Example 5 (Comparison) | P-3 | 323 | Dispersion-1 | UV-1: 106<br>UV-2: 106<br>HBS: 148 |
| Example 6 (Comparison) | P-4 | 323 | Dispersion-1 | UV-1: 106<br>UV-2: 106<br>HBS: 148 |
| Example 7 (Invention) | P-1 | 323 | Dispersion-1 | UV-1: 106<br>UV-2: 106<br>HBS: 148 |
| Example 8 (Invention) | P-2 | Polymer: 323<br>UV-1: 106 | Dispersion-2 | UV-2: 106<br>HBS: 35.3 |

*HBS: high boiling organic solvent
UV-1: Ultraviolet Ray Absorber I
UV-2: Ultraviolet Ray Absorber II Evaluation of ferrotyping resistance:

A group of six 35 mm strips having a length of 305 mm (12 inches) of the feature film (processed) are placed in a 80% relative humidity (RH) chamber for a mini num of 16 hours. The strips are stacked, sensitized side to unsensitized side and wrapped in foil, placed inside a moisture proof wrap, and sealed. The sealed package is then placed above a flat glass plate and under a brass bar of the same size with weight of 6.89 kgs (15 lbs). The package, with the glass plate and brass bar is then placed in a 37.8° C. (100° F.) room for 17 hours. After storage, the bag is opened, the top and bottom strips are discarded, and the remaining strips are visually inspected for ferrotyping against the following scale:

| Value | % of area showing ferrotyping |
|---|---|
| A | 0 to <5% |
| B | 5 to <20% |
| C | 20 to <50% |
| D | 50 to 100% |

The results are reported in Table 4.

Evaluation of surface defects:

The appearance of surface defects is evaluated by using scanning electron microscope. Surface defects or bumps larger than 5 $\mu$m are considered to 5 be harmful to photographic properties and printable or visible in prints of projections. The results are reported in terms of "many" or "none". "Many" indicates that there are numerous surface defects caused by the presence of polymer particles. "None" indicates that no surface defects larger than 5 $\mu$m are present. The results are reported in Table 4.

TABLE 4

| Example | Ferrotyping 37.8° C./80% RH | Surface Defects |
|---|---|---|
| Example 5 (Comparison) | A | Many |
| Example 6 (Comparison) | C | None |
| Example 7 (Invention) | A | None |
| Example 8 (Invention) | A | None |

The results in Table 4 demonstrate that the photographic elements prepared in accordance with the present invention show excellent surface appearance and resistance to post process ferrotyping.

The invention has been described in detail with particular reference to certain preferred embodiments thereof, but it will be understood that variations and modifications can be effected within the spirit and scope of the invention.

What is claimed is:

1. A method of making a photographic element comprising:

providing a support having thereon at least one silver halide emulsion layer;

mechanically forming oil-in-water droplets having a size less than 250 nm of an ethylenically unsaturated monomer and hydrophobic groups, the hydrophobic groups having a $\log P_{(calc)}$ greater than a $\log P_{(calc)}$ of the ethylenically unsaturated monomer by at least 1 unit in an aqueous medium;

adding to the aqueous medium a hydrophilic colloid in an amount sufficient to render the polymer particle compatible with the hydrophilic binder;

polymerizing said droplets so that the polymerized droplets have a size of less than 250 nm and a glass transition temperature of at least 70° C., coating said polymerized droplets and the hydrophilic binder over said at least one silver halide emulsion layer: and drying said polymerized droplets and hydrophilic binder to form a light-insensitive protective overcoat.

2. The method of claim 1 wherein the hydrophilic colloid is selected form the group consisting of gelatin, polyvinyl alcohol, polyvinyl pyrrolidone, starch, and natural gum.

3. The method of claim 1 wherein the hydrophilic colloid is present in an amount of at least 0.1 weight percent based on the weight of the monomer.

4. The method of claim 1 further comprising;

adding a dispersion stabilizer to the aqueous medium prior to mechanically forming oil-in-water droplets.

5. The method of claim 4 wherein the dispersion stabilizer is selected from the group consisting of sulfonated alkyl aryl polyethers, ethylene glycol ethers of polyhydric alcohols, carboxy alkyl substituted polyglycol ethers, carboxy alkyl substituted polyglycol esters, fluoro-substituted compounds, sucrose esters of aliphatic acids, maleic ester amides, sodium salts of the condensation products of naphthalene sulfonic acid and formaldehyde, phosphate esters of glycol polyethers, long chain sucrose ethers, alcohol sulfates, water soluble salts of aliphatic esters of sulfosuccinic acid, fatty acid esters of hydroxy alkyl sulfonic acids, amide derivatives of sulfon-acetic acid, and ester derivatives of sulfon-acetic acid.

6. The method of claim 1 wherein the hydrophobic groups comprise at least about 0.01 weight percent of ethylenically unsaturated monomer.

7. The method of claim 1 wherein the hydrophobic groups are selected from the group consisting of alkanes, alkenes, substituted aromatic compounds, haloalkanes, methyl laurate, butyl laurate, methyl oleate, butyl oleate, methyl stearate, isopropyl palmitate, isopropyl stearate, tributyl citrate, acetyl tributyl citrate, dibutyl phthalate, dioctyl phthalate, dioctyl terephthalate, dibutyl sebacate, didecyl succinate, bis(2-ethylhexyl) azelate, lauramide, N-methyllauramide, N,N-dimethyllauramide, N,N-dibutyllauramide, N-decyl-N-methylacetamide, N-oleylphthalimide, sulfates, sulfonates, sulfonamides, sulfoxides, phosphates, phosphonates, phosphinates, phosphites, and phosphine oxides.

8. The method of claim 1 wherein the ethylenically unsaturated monomer is selected from the group consisting of alkyl esters of acrylic acid, alkyl esters of methacrylic acid, hydroxyalkyl esters of acrylic acid, hydroxyalkyl esters of methacrylic acid, nitriles of acrylic acid, nitriles of methacrylic acid, amides of acrylic acid, amides of methacrylic acid, vinyl acetate, vinyl propionate, vinylidene chloride, vinyl chloride, styrene, t-butyl styrene, ethyl vinyl benzene, vinyl toluene, dialkyl maleates, dialkyl itaconates, dialkyl malonates, isoprene, and butadiene.

9. The method of claim 1 wherein the droplets further comprise crosslinking or grafting monomers selected from the group consisting of, esters of unsaturated monohydric alcohols with unsaturated monocarboxylic acids, esters of saturated glycols with unsaturated monocarboxylic acids, esters of diols with unsaturated monocarboxylic acids, and divinyl benzene.

10. The method of claim 1 wherein the polymerizing step is initiated with a free radical initiator selected from the group consisting of persulfates, peroxides, azo compounds, and redox initiators.

11. The method of claim 10 wherein the free radical initiator is present in an amount of from 0.01% to 2% by the weight of monomer.

12. The method of claim 1 wherein the support is selected from the group consisting of papers, glass, acetate polymers and polyesters.

13. The method of claim 1 wherein the hydrophilic binder is selected from the group consisting of proteins, protein derivatives, cellulose derivatives, polysaccharides, synthetic water permeable colloids acrylamide polymers, poly(vinyl alcohol), derivatives of poly(vinyl alcohol), hydrolyzed polyvinyl acetates, polymers of alkyl acrylates, polymers of alkyl sulfoalkyl acrylates, polymers of alkyl methacrylates, polymers of alkyl sulfoalkyl methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymers containing styrene sulfonic acid, and copolymers containing styrene sulfonic acid.

14. The method of claim 1 wherein the hydrophilic binder is crosslinked with a crosslinking agent selected from the group consisting of aldehydes, epoxy compounds, polyfunctional aziridines, vinyl sulfones, methoxyalkyl melamines, triazines, polyisocyanates, dioxane derivatives, carbodiimides, chrome alum, and zirconium sulfate.

15. A method of making a photographic element comprising:

providing a support having thereon at least one silver halide emulsion layer;

mechanically forming oil-in-water droplets having a size less than 250 nm of an ethylenically unsaturated monomer having a $\log P_{(calc)}$ of greater than 4;

adding to the aqueous medium a hydrophilic colloid in an amount sufficient to render the polymer particle compatible with the hydrophilic binder;

polymerizing said droplets so that the polymerized droplets have a size of less than 250 nm and a glass transition temperature of at least 70° C., coating said polymerized droplets with a binder over the at least one light insensitive layer; and drying said polymerized droplets and binders to form a light insensitive protective overcoat.

16. The method of claim 15 wherein the hydrophilic colloid is selected form the group consisting of gelatin, polyvinyl alcohol, polyvinyl pyrrolidone, starch, and natural gum.

17. The method of claim 15 wherein the hydrophilic colloid is present in an amount of at least 0.1 weight percent based on the weight of the monomer.

18. The method of claim 15 further comprising;

adding a dispersion stabilizer to the aqueous medium prior to mechanically forming oil-in-water droplets.

19. The method of claim 18 wherein the dispersion stabilizer is selected from the group consisting of sulfonated alkyl aryl polyethers, ethylene glycol ethers of polyhydric alcohols, carboxy alkyl substituted polyglycol ethers, carboxy alkyl substituted polyglycol esters, fluoro-substituted compounds, sucrose esters of aliphatic acids, maleic ester amides, sodium salts of the condensation products of naphthalene sulfonic acid and formaldehyde, phosphate esters of glycol polyethers, long chain sucrose ethers, alcohol sulfates, water soluble salts of aliphatic esters of sulfosuccinic acid, fatty acid esters of hydroxy alkyl sulfonic acids, amide derivatives of sulfon-acetic acid, and ester derivatives of sulfon-acetic acid.

20. The method of claim 15 wherein the ethylenically unsaturated monomer is selected from the group consisting of alkyl esters of acrylic acid, alkyl esters of methacrylic acid, hydroxyalkyl esters of acrylic acid, hydroxyalkyl esters of methacrylic acid, nitriles of acrylic acid, nitriles of methacrylic acid, amides of acrylic acid, amides of methacrylic acid, vinylidene chloride, t-butyl styrene, dialkyl maleates, dialkyl itaconates, and dialkyl malonates.

21. The method of claim 15 wherein the droplets further comprise crosslinking or grafting monomers selected from the group consisting of, esters of unsaturated monohydric alcohols with unsaturated monocarboxylic acids, esters of saturated glycols with unsaturated monocarboxylic acids, esters of diols with unsaturated monocarboxylic acids, and divinyl benzene.

22. The method of claim 15 wherein the polymerizing step is initiated with a free radical initiator selected from the group consisting of persulfates, peroxides, azo compounds, and redox initiators.

23. The method of claim 22 wherein the free radical initiator is present in an amount of from 0.01% to 2% by the weight of monomer.

24. The method of claim 15 wherein the support is selected from the group consisting of papers, glass, acetate polymers and polyesters.

25. The method of claim 15 wherein the hydrophilic binder is selected from the group consisting of proteins, protein derivatives, cellulose derivatives, polysaccharides, synthetic water permeable colloids acrylamide polymers, poly(vinyl alcohol), derivatives of poly(vinyl alcohol), hydrolyzed polyvinyl acetates, polymers of alkyl acrylates, polymers of alkyl sulfoalkyl acrylates, polymers of alkyl methacrylates, polymers of alkyl sulfoalkyl methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymers containing styrene sulfonic acid, and copolymers containing styrene sulfonic acid.

26. The method of claim 15 wherein the hydrophilic binder is crosslinked with a crosslinking agent selected from the group consisting of aldehydes, epoxy compounds, polyfunctional aziridines, vinyl sulfones, methoxyalkyl melamines, triazines, polyisocyanates, dioxane derivatives, carbodiimides, chrome alum, and zirconium sulfate.

27. The method of claim 15 wherein the protective overcoat further comprises thickeners, ultraviolet ray absorbers, processing removable dyes, silver halide, colloidal inorganic particles, magnetic recording particles, lubricants, coating aids, matting agents, antistats or charge control surfactants.

28. The method of claim 15 further comprising at least one electrically conductive layer.

* * * * *